United States Patent [19]

Hitzig

[11] Patent Number: 4,802,308

[45] Date of Patent: Feb. 7, 1989

[54] MEANS FOR PREVENTING AIR LEAKAGE THROUGH WINDOW SASH INTERLOCK

[76] Inventor: Geoffrey Hitzig, 175 Kennedy Dr., Hauppauge, N.Y. 11788

[21] Appl. No.: 152,861

[22] Filed: Feb. 5, 1988

[51] Int. Cl.[4] ..... E05D 15/16

[52] U.S. Cl. ..... 49/406; 49/453; 49/485

[58] Field of Search ..... 49/406, 404, 415, 416, 49/417, 423, 480, 485, 453, 437, 310, 311, 312, 424, 466, 465

[56] References Cited

U.S. PATENT DOCUMENTS

| | | | |
|---|---|---|---|
| 2,763,344 | 9/1956 | Peterson | 189/64 |
| 2,952,883 | 9/1960 | Kessler et al. | 20/52.2 |
| 3,114,177 | 12/1963 | Simard et al. | 20/52 |
| 3,208,111 | 9/1965 | Grossman | 20/52.2 |
| 3,325,944 | 6/1967 | Crain | 49/406 |
| 3,538,642 | 10/1970 | Fredricksen | 49/213 |
| 3,698,883 | 10/1972 | DiFazio | 49/449 |
| 4,327,524 | 5/1982 | Vanderlaan | 49/425 |

*Primary Examiner*—Kenneth J. Dorner
*Assistant Examiner*—Gerald A. Anderson
*Attorney, Agent, or Firm*—Charles E. Temko

[57] ABSTRACT

A means for preventing air leakage through the sealing means existing between a pair of relatively movable sash elements in the area where the sealing zone is normally interrupted to permit planar movement of the sash perpendicular to its normal direction of movement to allow removal of the sash relative to a supporting window frame. The novel structure includes a resilient member which is manually shiftable in a direction perpendicular to the plane of the window sash when removal of the sash is desired.

2 Claims, 2 Drawing Sheets

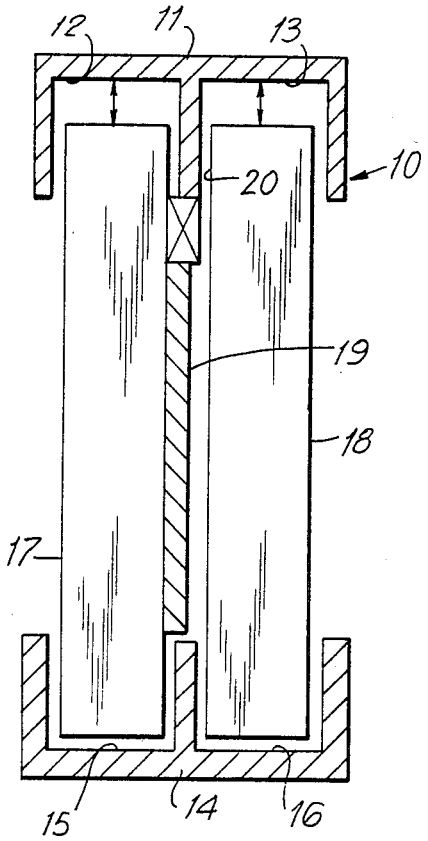
FIG. 1
FIG. 3
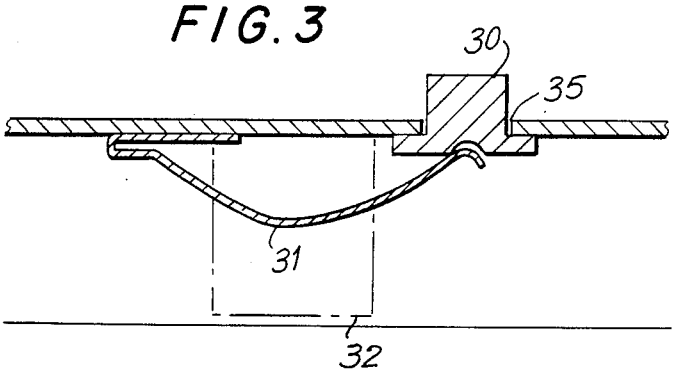

MEANS FOR PREVENTING AIR LEAKAGE THROUGH WINDOW SASH INTERLOCK

BACKGROUND OF THE INVENTION

This invention relates generally to the field of window construction, and more particularly to an improved manually displaceable means for completing the seal which exists between a pair of adjacent sash elements when the window is completely closed.

While most windows used for residential construction are of the so-called double hung type, in recent years there has been increased usage of a relatively lower cost horizontally sliding window which is dimensionally wider than high, and in which a pair of sash elements are arranged for movement along a horizontal axis while entrained within upper and lower grooves or tracks. The grooves are relatively deep at the upper end of the window frame, and the sashes are removable from the frame by vertically raising them to a point where the lower edge of the sash element clears the lower groove or track which supports it. Glass patio doors are often constructed in a somewhat similar manner.

In both double hung windows and the horizontally sliding window, it is necessary to provide some type of resilient seal in the area of sash overlap to prevent the entry of cold air into the building. This has been accomplished in a variety of ways, including metallic weather stripping, as well as felt strips and the like. In the case of the horizontally sliding window, there exists a problem in that a portion of such seal must be interrupted at an upper end thereof in order to allow the sash to be raised within the upper groove in order to accomplish the demounting of the sash. While it is possible to place a loose stuffing in this area, it will be readily lost as soon as the sash is , shifted.

SUMMARY OF THE INVENTION

Briefly stated, the invention contemplates the provision of a window construction of the class described, in which the above-mentioned disadvantage has been substantially resolved. To this end, there is provided a resiliently displaceable sealing member selectively occupying the area in which the normal seal is interrupted. Most conveniently, the sealing member is in the form of a spring urged rigid button which is manually displaced at the time of installation of the sash and its removal, and which substantially completely fills the void during normal use

BRIEF DESCRIPTION OF THE DRAWINGS

In the drawings, to which reference will be made in the specification, similar reference characters have been employed to designate corresponding parts throughout the several views.

FIG. 1 is a schematic transverse sectional view of an embodiment of the invention.

FIG. 3 is a fragmentary enlarged horizontal sectional view thereof.

DETAILED DESCRIPTION OF THE DISCLOSED EMBODIMENT

Figure 2:
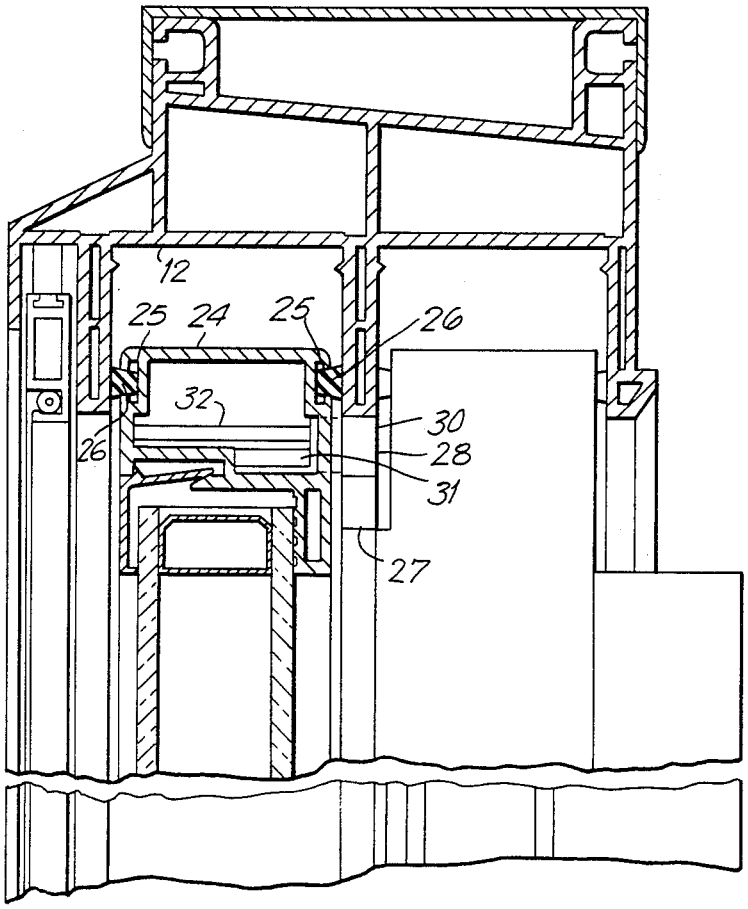
FIG. 2 is a fragmentary enlarged vertical sectional view thereof.

In accordance with the invention, reference character 10 designates a horizontally sliding window, of known type embodying the invention. Windows of this type are generally horizontally oriented, and include a frame having a top header 11 defining first and second tracks 12 and 13, as well as a bottom horizontal frame member 14 forming third and fourth tracks 15 and 16. Supported within the tracks 12–13, and 15–16, are first and second substantially similar sashes 17 and 18, one of which is provided with an air sealing interlock 19 in the area in which the first and second sashes overlap when the window is in closed condition. This interlock, which may be in the form of weather stripping, felt material or similar sealing structure, is necessarily interrupted a short distance from the top edge of the sash in order to permit the sash to be raised while still engaging one of the tracks 12–13, to a point where it clears a corresponding track 15–16 , to permit removal of the frame for cleaning, replacement or other operation. It is through the interstice 20, thus created, that cold air may travel from the outside of the building to the interior thereof. While it is possible to plug this interstice using loose felt, crumpled paper or other suitable filler, it will be apparent that such expedient is necessarily of a temporary nature, and the sealing effect will be lost should the window be opened, or should the plug be otherwise disturbed.

Referring to FIG. 2 in the drawing, the sash 17 includes an upper edge member 24 which defines vertical recesses 25 accommodating horizontally oriented seals 26 which bear against the respective track 12 to prevent leakage along the horizontal surfaces of the sash. The vertical seal 27 includes an open area approximately three-quarters of an inch in height designated by reference character 28 which must be closed if air leakage is to be avoided. In accordance with the invention, there is provided a retractable push button 30 urged to outwardly extending position by a leaf spring 31 maintained in position by a spring retainer 32, the spring 31 and retainer 32 being normally positioned within the hollow interior of the sash. The button projects through an opening 35 in one wall of the sash.

As will be apparent from a consideration of the drawing, the button is of size such that the height thereof corresponds to the recess 25, so that it will effectively fill the interstice 20 when in extended condition. It will normally be in this condition except when it is required to remove the sash in which it is installed, at which point it is pushed inwardly to form the interstice so that the sash may be lifted and removed in normal manner. When replacing the sash, the button will again be pushed to provide the interstice required to permit installation, and as soon as the sash is allowed to fall into the respective lower track 15, the button is again released, and the interstice again filled. The button also forms a means whereby the sash cannot be removed by an intruder working from the outside of the building, since he is not able to lift the sash as long as the button remains extended, and he does not have access to the button as long as he is on the outside of the building.

I wish it to be understood that I do not consider the invention to be limited to the precise details of structure shown and set forth in this specification, for obvious modification pertains.

I claim:

1. In a window construction including a window frame, a pair of parallel horizontally sliding sash elements carried by said frame in upper and lower grooves therein for movement between open and closed positions, said sash elements being removable by raising said sash elements to enable the lower edge of said sash elements to clear a respective lower groove, resilient means carried by at least one vertical edge of one of said sash elements to effect a seal over an elongated area in which said sash elements mutually overlap when said sash elements are in closed position; said sealing means being interrupted to form an interstice at an upper end thereof to permit removal of said sash elements, the improvement comprising: a resiliently mounted manually actuated push button having an axis of movement perpendicular to the plane of sliding movement of said sash elements, said push button being mounted in one of said sash elements and selectively retractable into said one of said sash elements; said push button in non-retracted condition filling said interstice to completely seal said elongated area.

2. The improvement in accordance with claim 1, further characterized in the provision of leaf spring means disposed within said sash element, one end of which urges said push button to non-retracted condition.

* * * * *